US010159312B2

(12) United States Patent
Ito

(10) Patent No.: US 10,159,312 B2
(45) Date of Patent: Dec. 25, 2018

(54) CAP, BUTTON GROUP AND METHOD FOR FORMING BUTTON GROUP

(71) Applicant: YKK Corporation, Tokyo (JP)

(72) Inventor: Nobuhisa Ito, Tokyo (JP)

(73) Assignee: YKK Corporation (JP)

( * ) Notice: Subject to any disclaimer, the term of this patent is extended or adjusted under 35 U.S.C. 154(b) by 324 days.

(21) Appl. No.: 15/025,923

(22) PCT Filed: Oct. 2, 2013

(86) PCT No.: PCT/JP2013/076881
§ 371 (c)(1),
(2) Date: Mar. 30, 2016

(87) PCT Pub. No.: WO2015/049752
PCT Pub. Date: Apr. 9, 2015

(65) Prior Publication Data
US 2016/0235167 A1 Aug. 18, 2016

(51) Int. Cl.
*A44B 1/02* (2006.01)
*A44B 1/08* (2006.01)
(Continued)

(52) U.S. Cl.
CPC ..... *A44B 1/08* (2013.01); *A44B 1/02* (2013.01); *A44B 1/06* (2013.01); *A44B 1/34* (2013.01); *A44B 1/44* (2013.01); *A44B 17/0088* (2013.01)

(58) Field of Classification Search
CPC ..... Y10T 29/13; Y10T 24/36; Y10T 24/3606; Y10T 24/367; Y10T 24/3698;
(Continued)

(56) References Cited

U.S. PATENT DOCUMENTS 2,690,645 A * 10/1954 Rueger ..... G04B 3/041 29/511
4,664,277 A * 5/1987 Connor ..... B29C 65/08 215/249

FOREIGN PATENT DOCUMENTS

EP 1066895 A2 1/2001
JP 079312/1985 6/1985
(Continued)

OTHER PUBLICATIONS

International Search Report, PCT Application No. PCT/JP2013/076881, dated Dec. 17, 2013.
(Continued)

*Primary Examiner* — Jack W Lavinder
(74) *Attorney, Agent, or Firm* — Kilpatrick Townsend & Stockton LLP

(57) ABSTRACT

There is provided a cap, which is one part of a button fastener. The cap comprises a bottom and a circumferential side rising from an edge of the bottom. The cap is composed of an inner layer made of aluminum or aluminum alloy as a first material and an outer layer made of copper or copper alloy as a second material. The first and second layer are laminated on each other continuously across the bottom and the circumferential side. A Vickers hardness of the second material may be harder than a Vickers hardness of the first material. A tensile strength of the first material may be less than 260 N/mm2, and a tensile strength of the second material may be equal to or higher than 260 N/mm2.

7 Claims, 6 Drawing Sheets

(51) Int. Cl.

| | |
|---|---|
| ***A44B 1/34*** | (2006.01) |
| ***A44B 1/06*** | (2006.01) |
| ***A44B 1/44*** | (2006.01) |
| *A44B 17/00* | (2006.01) |

(58) Field of Classification Search
CPC ..... Y10T 29/49918; Y10T 29/49586; Y10T 29/49934; Y10T 24/3672; Y10T 24/3694; A44B 1/02; A44B 1/04; A44B 1/06; A44B 1/08; A44B 1/14; A44B 17/0088; A44B 1/34; A44B 1/44; A44B 17/0082; A44B 17/0064; B21D 51/04; B21D 53/48; B21D 51/26
See application file for complete search history.

(56) References Cited

FOREIGN PATENT DOCUMENTS

| | | | |
|---|---|---|---|
| JP | S60-079312 | U | 6/1985 |
| JP | 63-22107 | U | 2/1988 |
| JP | S63-22107 | U | 2/1988 |
| JP | 2001-008714 | A | 1/2001 |

OTHER PUBLICATIONS

International Preliminary Report on Patentability, PCT Application No. PCT/JP2013/076881, dated Apr. 14, 2016.

* cited by examiner

CAP, BUTTON GROUP AND METHOD FOR FORMING BUTTON GROUP

This application is a national stage application of PCT/JP2013/076881, which is incorporated herein by reference.

BACKGROUND OF THE INVENTION

The present invention relates to a cap, a button group and a method for forming a button group, and more particularly relates to a cap, which is one part of a button or a button fastener; a button or a button as a button group with a cap, and a method for forming such a button or a button fastener.

As a button or a button fastener, one type is known which includes a main body for a button or a button fastener and a cap (also referred to as a shell) which is attached to the main body. An outer surface of the cap becomes a front surface of a button or a button fastener, on which a design such as characters, logos and the like may be printed or impressed. One example of a button having such a cap is disclosed in JP,S63-22107,U, for instance. This document shows a shell member 4 as a cap in FIG. 1. Such a cap is attached to a button main body by swaging a circumferential side of the cap against the main body (a button back member 3 in FIG. 1 of the document). As mentioned above, since the outer surface of the cap becomes the front surface of the button or the like, the cap is typically made of copper or copper alloy that is relatively hard to scratch. However, in a case of the cap made of copper or copper alloy, spring back tends to occur when the circumferential side of the cap is swaged to the main body using a die or the like. In the spring back, the deformed circumferential side is somewhat returned toward its original state when the die or the like is removed. For this reason, there is a fear that a coupling force of the cap to the main body would be weaken over time. In this case, the cap would be rotated with respect to the main body. Under this situation, if a design of oriented characters and the like is drawn on the outer surface of the cap, namely, the front surface of the button, and this button is attached to clothing or the like in a predetermined orientation, there would be a problem that a rotation of the cap causes the orientation of the design to be displaced. To solve the problem, JP,S63-22107,U as mentioned above suggests a technique that adds a separate reinforcement member (10) to a cap (shell member 6). (refer to FIGS. 3 and 4 of the gazette).

However, the addition of a separate member to the cap increases the number of parts and consequently leads to a cost rise. Further, a process for manufacturing a button and the like would be complicated. In addition, a material cost of copper or copper alloy is expensive relatively to aluminum or aluminum alloy. However, though aluminum or aluminum alloy is relatively hard to induce a spring back, there would be a problem that the outer surface of a cap is easy to scratch.

[Patent Document 1] JP,S63-22107,U

SUMMARY OF INVENTION

The present invention is proposed in view of the above problems. Therefore, an object of the present invention is to provide a cap, a button group and a method for forming a button group, which can prevent the cap from being rotated with respect to a body, which may be induced with age, without any increase of the number of parts, and is advantageous in cost.

In order to solve the above problems, according to one aspect of the present invention, there is provided a cap of a button or button fastener, comprising a bottom and a circumferential side rising from an edge of the bottom, wherein the cap is composed of an inner layer made of a first material and an outer layer made of a second material which is different from the first material, the inner layer and the outer layer being laminated on each other continuously across the bottom and the circumferential side rising from the bottom, and wherein the first material is aluminum or aluminum alloy.

In the present invention, a cap as one part of a button or a button fastener is composed of an inner layer made of aluminum or aluminum alloy that is a first material and an outer layer made of a second layer different from aluminum or aluminum alloy. The outer layer is laminated on one surface of the inner layer. The cap has a bottom and a circumferential side rising from an edge of the bottom. The inner and outer layers are laminated on each other continuously all over the bottom and the circumferential side. As a concrete example of the second material making the outer layer, copper or copper alloy is listed, but not limited to it. As other second materials, nickel or nickel alloy, zinc or zinc alloy and the like can be cited. As copper alloy, for example, there are copper-zinc system and copper-tin system. As nickel alloy, for example, there are nickel-copper system and nickel-copper-zinc system. As zinc alloy, for example, there are zinc-tin system and zinc-aluminum system.

In an embodiment of the present invention, a Vickers hardness of the second material is harder than a Vickers hardness of the first material. Thereby, when the circumferential side of the cap is swaged to a main body of a button or a button fastener, it would possible to reduce a spring back at the swaging by the inner layer of aluminum or aluminum alloy. Further, since the outer layer is made of the material that would be harder in Vickers hardness than aluminum or aluminum alloy, the outer surface of the cap is hard to scratch. In the present invention, for example, the Vickers hardness of the first material can be set between 26 Hv or more and 95 Hv or less, and the Vickers hardness of the second material can be set between 100 Hv or more and 175 Hv or less. By using the first and second materials with those ranges of the Vickers hardness, it would be possible to provide a cap whose outer surface would be scratch-resistant.

In an embodiment of the present invention, a tensile strength of the first material is less than 260 N/mm2, and a tensile strength of the second material is equal to or higher than 260 N/mm2. Generally, a spring back that may occur as the circumferential side of the cap is swaged becomes great when the tensile strength exceeds 260 N/mm2. Thus, in order to reduce a spring back, the tensile strength of the material of the cap is desired to be less than 260 N/mm2. However, in this case, the strength of the cap is reduced as well. In this embodiment, the tensile strength of the inner layer is set to be less than 260 N/mm2, and the tensile strength of the outer layer is set to be 260 N/mm2 or more. Hence, a spring back of the inner layer would be reduced while the strength in the outer layer would be kept. In the present invention, for example, the tensile strength of the first material can be set to be 200 N/mm2 or less. In this case, it would be possible to further reduce a spring back.

According to another aspect of the present invention, there is provided a button group that includes a button group body and a cap which is attached to the button group body by swaging a circumferential side of the cap, wherein the cap comprises a bottom and a circumferential side rising from an edge of the bottom, wherein the cap is composed of an inner layer made of a first material and an outer layer made of a second material which is different from the first material, the inner layer facing the button group body, the outer layer being laminated on one surface of the inner layer which is opposite to the other surface facing the button group body, the inner layer and the outer layer being laminated on each other continuously across the bottom and the circumferential side rising from the bottom, and wherein the first material is aluminum or aluminum alloy.

In this invention, the button group is a button or a button fastener, and the cap corresponds to the cap according to one aspect of the present invention as mentioned above. In this invention, the cap as one part of the button group is composed of an inner layer made of aluminum or aluminum alloy and an outer layer made of a second material different from aluminum or aluminum alloy. The outer layer is laminated on one surface of the inner layer. The cap has a bottom and a circumferential side rising from an edge of the bottom. Then, the inner and outer layers are laminated on each other continuously all over the bottom and the circumferential side. By using the second material that is harder in Vickers hardness than the first material, it would be possible to reduce a spring back by the inner layer of aluminum or aluminum alloy when the circumferential side of the cap is swaged to the button group body. Further, if the outer layer is made of a material that is more rigid in Vickers hardness than aluminum or aluminum alloy, the outer surface of the cap would be scratch-resistant. As a concrete example of the second material making the outer layer, copper or copper alloy can be listed, but not limited to it. As other examples, nickel or nickel alloy, zinc or zinc alloy and the like can be cited.

According to still another aspect of the present invention, a method for forming a button group that includes a button group body and a cap, comprising: a step of overlapping a first plate made of a first material and a second plate made of a second material on each other; a step of punching out the overlapped first and second plates and then molding it into a cup-shaped cap with the first plate placed on an inner side of the cap, the cap comprising a bottom and a circumferential side rising from the bottom and extending from an edge of the bottom; and a step of swaging the circumferential side of the cap to the button group body to hold the button group body.

In this invention, the button group is a button or a button fastener. In this invention, a cap is punched out from the overlapped first plate and the second plates while the cap is molded into a cup-shape. Therefore, for example, even if the cap is plated, a plating solution does not remain between the first and second plates. In this invention, the first material is, for example, aluminum or aluminum alloy, and the second material is, for example, copper or copper alloy, nickel or nickel alloy, zinc or zinc alloy, or the like.

In the present invention, the cap that is one part of a button or a button fastener comprises an inner layer made of aluminum or aluminum alloy and an outer layer made of a second material different from aluminum or aluminum alloy. The outer layer is laminated on one surface of the inner layer continuously across the bottom and the circumferential side. Thereby, it would be possible to reduce a spring back that may occur when the circumferential side of the cap is swaged, without increasing the number of parts. Therefore, it would be possible to prevent the cap from being rotated with respect to the main body. Such a rotation may occur over time. Further, since aluminum or aluminum alloy, which is cheaper than copper or copper alloy is used for a part of the cap, it would be cost effective as compared with a conventional cap made of only copper or copper alloy.

DETAILED DESCRIPTION OF THE INVENTION

Figure 1:
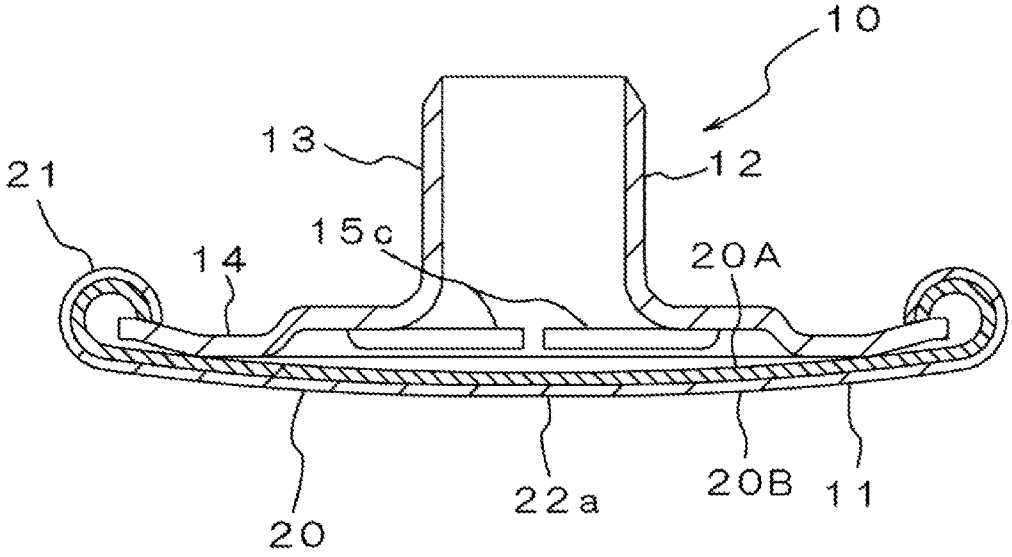
FIG. 1 is a cross-sectional view that shows an embodiment of a button fastener that uses a cap according to the present invention.
Figure 4:
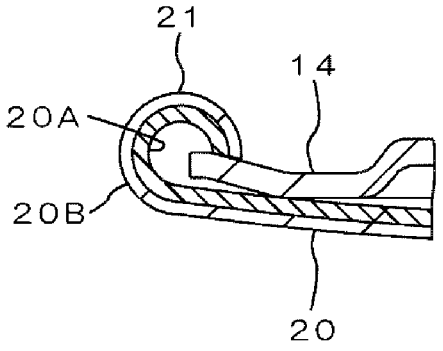
FIG. 4 is an enlarged view of a vicinity of a circumferential side of the cap in FIG. 1.
Figure 6:
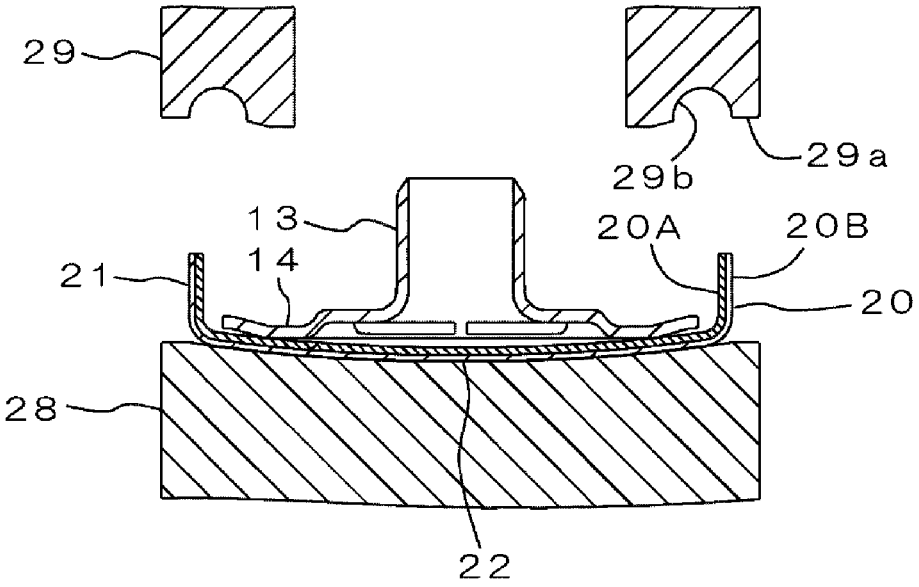
FIG. 6 is a process explanation view that shows a state just before the cap is attached to the fastener body.
Figure 8:
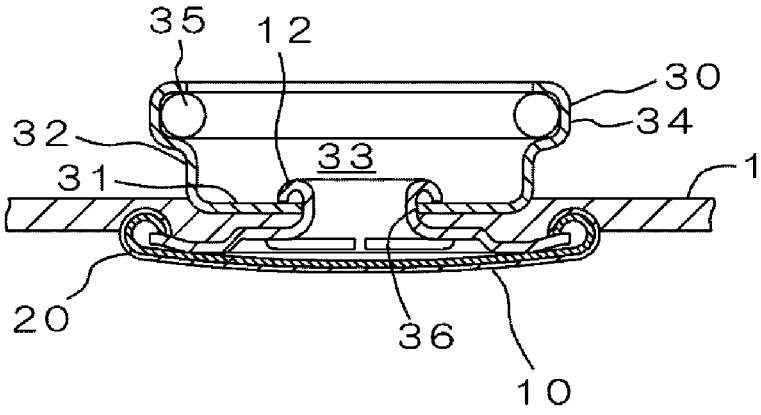
FIG. 8 is a cross-sectional view that shows a state in which the button fastener in FIG. 1 is used to fix a female snap button to a cloth.

Hereinafter, preferable embodiments of the present invention will be described below with reference to the drawings. However, the present invention is not limited to those embodiments, and modifications, etc. may be made to the embodiments within the scope of the claims and a range of equivalents. FIG. 1 is a cross-sectional view that shows an embodiment of a button fastener (hereafter, merely referred to as "fastener") 10 as one example of a button group that uses a cap 20 according to the present invention. The fastener 10 has: an approximately circular, plate-like base 11; and a cylindrical post 12 that extends upward from the base 11 (an up-and-down direction is based on FIG. 1) concentrically with the base 11. The fastener 10 is intended to attach a button such as a female snap button 30 or the like to a cloth 1 as shown in FIG. 8 by swaging the post 12 that just has penetrated through the cloth 1. The fastener 10 is composed of only two parts, namely, a fastener body 13 as a button group body and the cap 20. The fastener body 13 is formed such as by drawing a metal plate, and makes the post 12 and a base core 14, which is an upper surface-side portion of the base 11. As the cap 20 is enlarged and shown in FIG. 4, its circumferential side 21 is swaged in C-shape and fixed to a radially outer end on the upper surface of the base core 14 of the fastener body 13. Accordingly, the cap 20 is attached to the base core 14 so as to cover the lower surface of the base core 14 from the lower side. Thereby, the cap 20 makes a lower surface-side portion of the base 11. Before the circumferential side 21 is swaged, as shown in FIG. 6, the cap 20 is in a cup-shape, which includes a circular plate-like bottom 22 and a circumferential side (namely, an outer circumferential side) 21 which extends upward from an edge (a radially outer end) of the bottom 22. A lower surface **22*a* of the cap 20 will become a front surface of the fastener 10. Hereafter, the lower surface 22*a* of the cap 20 is also referred to as the front surface 22***a* of the fastener 10. It can be said that the circumferential side 21 extends upward from the edge of the bottom 22.

Figure 2:
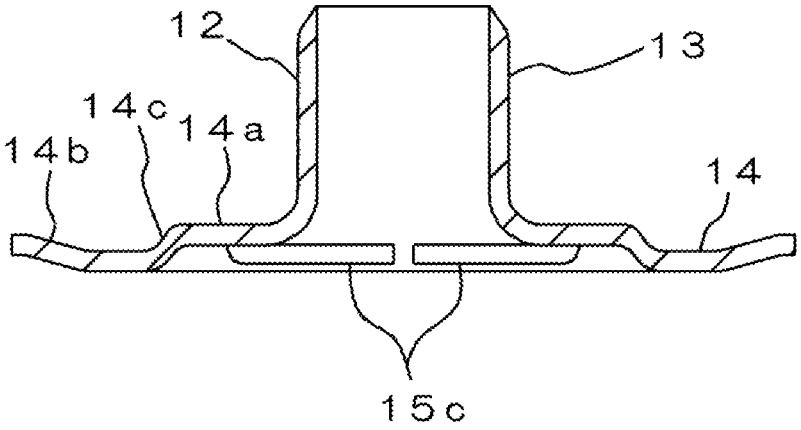
FIG. 2 is a cross-sectional view of a fastener body.
Figure 3:
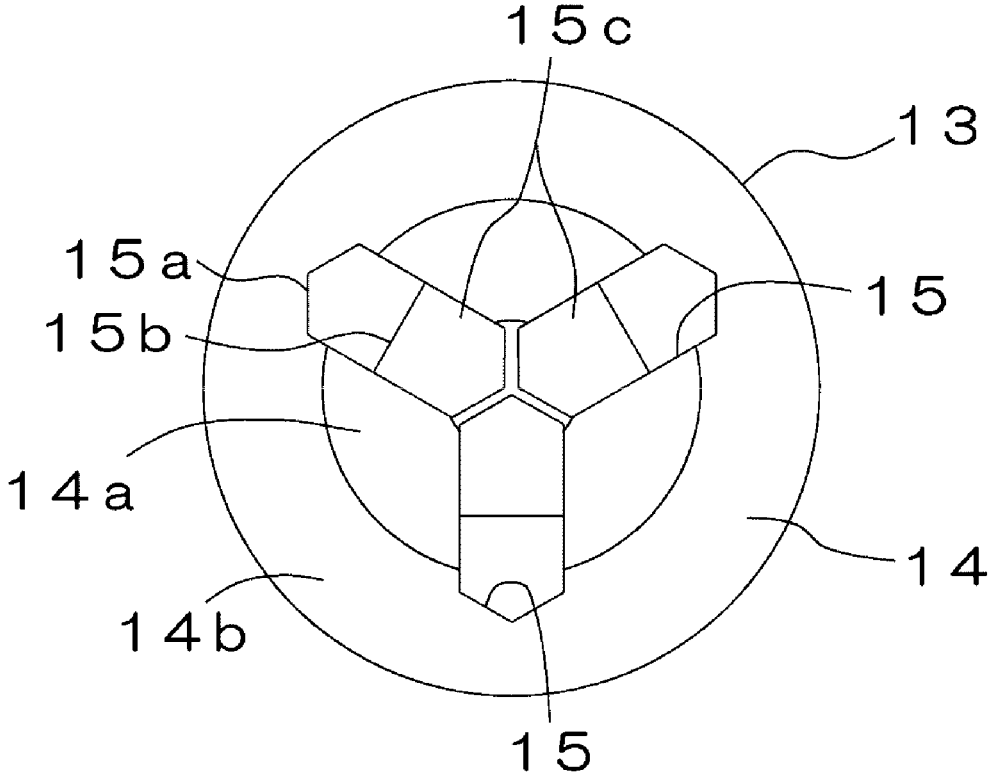
FIG. 3 is a bottom view of the fastener body.

FIGS. 2 and 3 are a cross-sectional view and a bottom view of the fastener body 13. The base core 14 of the fastener body 13 has three openings 15, which are arranged at an equal interval in the circumferential direction and each of which has a home base shape. Each opening 15 is arranged so that a top 15*a* of the home base shape is oriented radially outward, and a bottom 15*b* of the home base shape, which is opposite to the top 15*a* is oriented radially inward. Each opening 15 is formed as follows: That is, the base core 14 is cut out in a home base shape except the bottom 15*b*, and then the cutout portion 15*c* is bent by 180 degrees to the lower surface-side of the base core 14. Thereby, the three cutout portions 15*c* almost close a lower opening of the post 12 of the fastener body 13. Also, the base core 14 of the fastener body 13 includes: a radially inner portion 14*a*; a radially outer portion 14*b*, which is located slightly lower than the radially inner portion 14*a*; and a connecting portion 14*c* connecting between the radially inner portion 14*a* and the radially outer portion 14*b*. Each cutout portion 15*c* bent from the opening 15 is located slightly higher than the lowest end of the radially outer portion 14*b*. Further, the top 15*a* of each opening 15 is within the range of the radially outer portion 14*b*, and the bottom 15*b* is within the range of the radially inner portion 14*a*.

The cap 20 is composed of: an inner layer 20A that faces the base core 14 of the fastener body 13; and an outer layer 20B that is laminated on the entire lower surface of the inner layer 20A. Thus, the inner layer 20A and the outer layer 20B are laminated continuously across the bottom 22 and the circumferential side 21 of the cap 20. Here, the word "continuity" means that the inner layer 20A and the outer layer 20B are laminated over the whole area without any gaps. In this embodiment, the inner layer 20A is made of aluminum or aluminum alloy as one example of a first material, and the outer layer 20B is made of copper or copper alloy as one example of a second material. The thickness of the inner layer 20A is 0.2 mm as an example, and the thickness of the outer layer 20B is 0.15 mm as an example. Therefore, the thickness of the cap 20 is 0.35 mm. This thickness is approximately equal to that of a conventional cap made of only copper or copper alloy. Thus, in the cap 20, an amount of copper or copper alloy to be used, which is expensive relative to aluminum or aluminum alloy, can be reduced as compared with a conventional cap. In Table 1 shows a Vickers hardness, a tensile strength, a specific gravity and so on of the inner and outer layers 20A, 20B in this embodiment.

TABLE 1

| | Material | Thickness | Vickers Hardness | Tensile Strength | Specific Gravity |
|---|---|---|---|---|---|
| Inner Layer (20A) | Aluminum/ Aluminum Alloy | 0.2 mm | 26 Hv~ 95 Hv | 200 N/mm$^2$ or less | 2.5 g/cm$^3$~ 2.8 g/cm$^3$ |
| Outer Layer (20B) | Copper or Copper Alloy | 0.15 mm | 100 Hv~ 175 Hv | 200 N/mm$^2$ or more | 8.4 g/cm$^3$~ 8.9 g/cm$^3$ |

In Table 1, the range of 26 Hv-95 Hv indicates the range between 26 Hv or more and 95 Hv or less, and the range of 100 Hv-175 Hv indicates the range of 100 Hv or more and 175 Hv or less. Also, with regard to the specific gravity, the range of 2.5 g/cm3-2.8 g/cm3) shows the range between 2.5 g/cm3 or more and 2.8 g/cm3 or less, and the range of 8.4 g/cm3-8.9 g/cm3 shows the range between 8.4 g/cm3 or more and 8.9 g/cm3 or less. In Table 1, regarding the Vickers hardness of the inner layer 20A and the Vickers hardness of the outer layer 20B, it can be understood that the lower limit value of the inner layer 20A is lower than the lower limit value of the outer layer 20B, and the upper limit value of the inner layer 20A is lower than the upper limit of the outer layer 20B. Also, with regard to the Vickers hardness of the outer layer 20B, 105 Hv or more is preferable. As can be seen from Table 1, the outer layer 20B is more rigid or harder in Vickers hardness than the inner layer 20A. Thereby, the front surface 22*a* of the fastener 10, which is defined by the outer layer 20B, is hard to scratch, similarly to a conventional cap made of only copper or copper alloy. Further, since the tensile strength of the inner layer 20A is 260 N/mm2 or less, a spring back in the inner layer 20A would be hard to occur when the circumferential side 21 of the cap 20 is curled, as compared with a case that a conventional cap made of only copper or copper alloy is curled. Thus, the cup 20 can surely hold the base core 14 as the circumferential side 21 is curled. More preferably, the tensile strength of the inner layer 20A is 200 N/mm2 or less. In this case, a spring back is further difficult to occur. Moreover, since the specific gravity of the inner layer 20A is between 2.5 and 2.8 g/cm3, the cap 20 is lighter than a conventional gap made of only copper or copper alloy, which has the same thickness as the cap 20. It is possible to obtain a cap that is lighter in weight than a conventional cap made of only copper or copper alloy by 30 to 40%. As examples of the first material whose hardness is between 26 Hv and 95 Hv, there are cited A1100-0 (Pure Aluminum), A1100-H24 (Pure Aluminum), A5052-0 (Al—Mg System), A5052-H34 (Al—Mg System), A5056-H112 (Al—Mg System), A5083-0 (Al—Mg System), A6063-T5 (Al—Mg—Si System) and the like. Also, with regard to the second material whose hardness is between 100 Hv and 175 Hv, there are cited C2600-H (Brass C2600), C2680-H (Brass C2600), C4250-H (Tin Bearing Brass), C7540R-1/2H (Nickel Silver) and the like. Nickel silver is an alloy composed of Nickel silver, copper, zinc and nickel.

Figure 5:
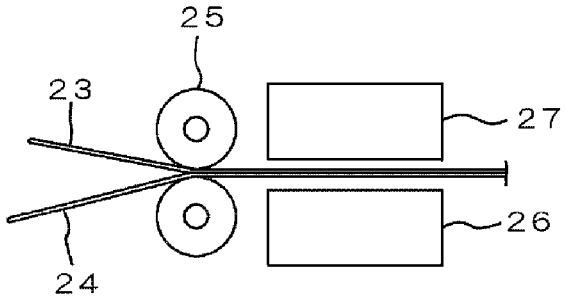
FIG. 5 is a process explanation view that shows a state in which a first plate and a second plate are overlapped with each other.

Next, a process for manufacturing the button fastener 10 as mentioned above will be described. FIG. 5 shows a process for overlapping a band-like first plate 23, which becomes the inner layer 20A of the cap 20, and a band-like second plate 24, which becomes the outer layer 20B on each other. The first plate 23 is made of aluminum or aluminum alloy, and the second plate 24 is made of copper or copper alloy. The first and second plates 23, 24 are fed from supply rolls not shown, respectively, and then laminated on each other while being passed between a pair of compressing rollers 25. Then, caps are punched out from the first and second plates 23, 24 between a lower die 26 and an upper punch 27. Simultaneously, each of the caps is molded into a cup shape. That is, when the cap 20 is molded into the cup shape (refer to FIG. 6) having the bottom 22 and the circumferential side 21 as the cap 20 is punched out between the die 26 and the punch 27. In FIG. 6, a side in contact with a die 28 becomes the inner layer 20A, and a side in contact with the fastener body 13 becomes the outer layer 20B. With this molding operation, the inner layer 20A and the inner layer 20A are integrated into one unit without any use of adhesive agent and the like between them. However, in order to surely laminate the inner layer 20A and the outer layer 20B on each other, it is possible to use adhesive agent and the like between them or provide minute bumps and dips on the laminated surface(s) of the inner layer 20A or (and) the outer layer 20B. Next, the cup-shaped cap 20 is washed and then attached to the fastener body 13.

Figure 7:
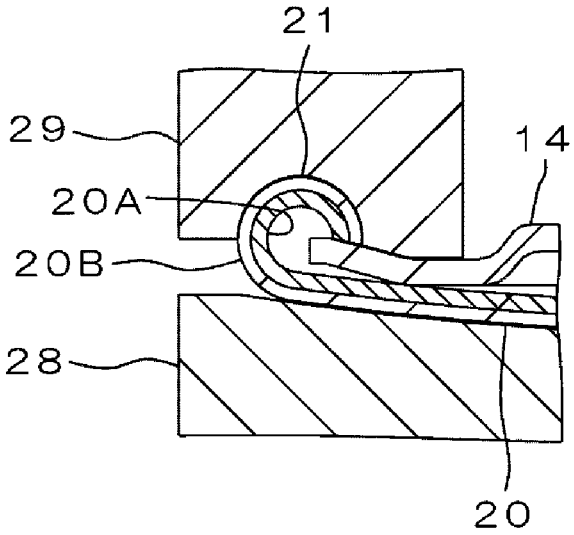
FIG. 7 is a process explanation view that shows a state in which the circumferential side of the cap is swaged.

FIG. 6 shows a state just before the cap 20 is attached to the fastener body 13. At this time, the cap 20 is placed on the die 28, and the circumferential side 21 of the cap 20 protrudes upward from the radially outer end of the bottom 22. Further, the fastener body 13 is put on the upper surface of the bottom 22 of the cap 20. A punch 29 is lowered from above to the cap 20 and the fastener body 13 in that state. The punch 29 has an annular concave 29*b* on a lower surface 29*a* of an annular lower part, and the concave 29*b* is recessed upward in a semi-circular shape. When the foregoing punch 29 is lowered, as enlarged and shown in FIG. 7, the circumferential side 21 of the cap 20 is swaged in C-shape radially inward along the concave 29*b* of the punch 29, and then fixed to the radially outer end on the upper surface of the base core 14 of the fastener body 13. Consequently, the cap 20 is attached to the fastener body 13. As mentioned above, with the inner layer 20A, a spring back is reduced when the circumferential side 21 of the cap 20 is swaged. Thereby reason, a rotation of the cap 20 with respect to the fastener body 13 over time will be hard to occur.

FIG. 8 is a cross-sectional view that shows a state in which the button fastener 10 is used to fasten the female snap 30 as one example of a button, to the cloth 1. The female snap 30 has a circular bottom 31 and an annular side 32 that extends upward (based on FIG. 8) from a radially outer end of the bottom 31. Inside the annular side 32, a space 33 is defined for receiving a protrusion of a male snap that is not shown. The side 32 includes an expanded portion 34, which is expanded radially outward at its upper end. Inside the expanded portion 34, a spring 35 is disposed to assure of an engagement with a protrusion of a male snap. In the bottom 31 of the female snap 30, an opening 36 is formed. When the female snap 30 is fixed to the cloth 1, the post 12 of the fastener 10 is penetrated upward through the cloth 1 and then passed through the opening 36 of the female snap 30. After that, the post 12 is swaged by a punch not shown. Thereby, the female snap 30 is fixed to the cloth 1 as shown in FIG. 8.

Figure 9:
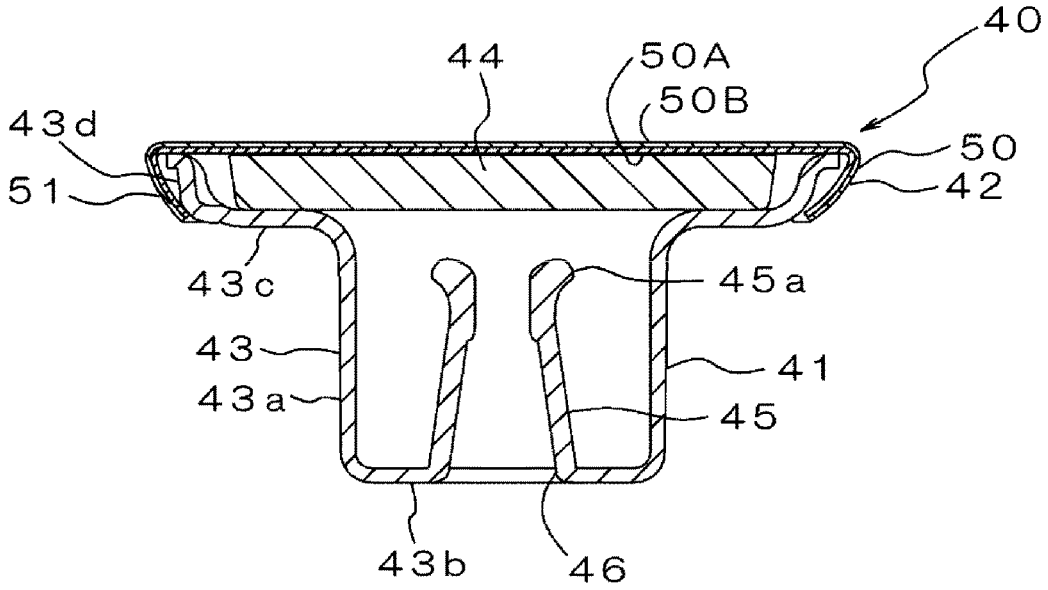
FIG. 9 is a cross-sectional view that shows an embodiment of a button that uses the cap according to the present invention.
Figure 10:
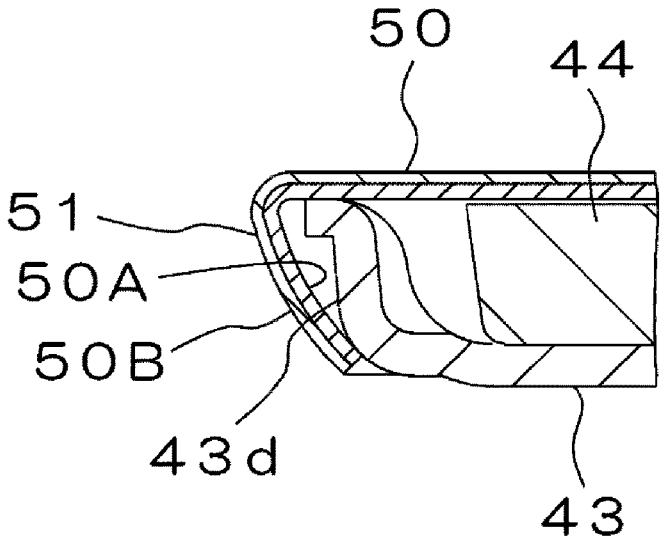
FIG. 10 is an enlarged view of a vicinity of the circumferential side of the cap in FIG. 9.

FIG. 9 is a cross-sectional view that shows an embodiment of a button 40 as one example of a button group using a cap 50 according to the present invention. The button 40 includes: a barrel 41 having a circular outer circumference; and a head 42 whose outer diameter expanding radially outward from the upper end (upper and lower are based on FIG. 9) of the barrel 41. The button 40 is composed of three parts, namely, a button body 43 as a button group body, a cap 50, and a reinforcement plate 44 disposed inside the head 42. The button body 43 is formed from a metal plate, and includes: a circumferential side 43*a* of the barrel 41; a bottom 43*b* of the barrel 41; a cylindrical part 45 that extends upward from the bottom 43*b* inside the circumferential side 43*a*; a head bottom 43*c* that extends radially outward from the upper end of the circumferential side 43*a*; and a head inner side 43*d* that extends upward from the radially outer end of the head bottom 43*c*. In the bottom 43*b* of the barrel 41, there is an opening 46 corresponding to the cylindrical part 45. In the cylindrical part 45, its diameter is gradually reduced upward, and the upper end of the cylindrical part 45 is spaced apart from the reinforcement plate 44. The upper end of the cylindrical part 45 is slightly expanded radially outward and serves as a locking portion 45*a* that locks a deformed top 62*a* of a shaft 62 of a button fastener 60 as described later. In the cap 50 of the button 40, its circumferential side 51 is swaged, from the outside, against the head inner side 43*d* of the button body 43 as enlarged and shown in FIG. 10. Thereby, the cap 50 is attached to the button body 43 and becomes an upper surface-side portion of the head 42. The upper surface of the cap 50 becomes the front surface of the button 40, on which a design such as characters, logos and the like is provided.

The cap 50 comprises an inner layer 50A that faces the button body 43 and the reinforcement plate 44 and an outer layer 50B that is laminated on the whole area of the upper surface of the inner layer 50A. The inner layer 50A is made of aluminum or aluminum alloy as one example of the first material, and the outer layer 50B is made of copper or copper alloy as one example of the second material. The Vickers hardness, the tensile strength and the specific gravity of each of the inner and outer layer 50A, 50B are almost the same as those of the cap 20 in the first embodiment.

Figure 11:
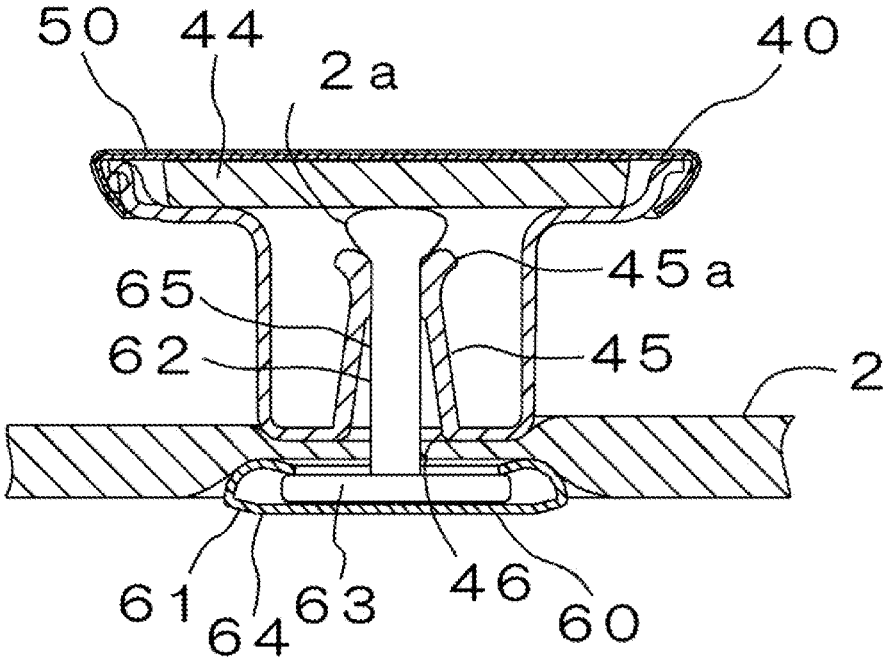
FIG. 11 is a cross-sectional view that shows a state in which the button in FIG. 9 is fixed to the cloth.

FIG. 11 is a cross-sectional view that shows a state in which the button 40 is fixed to a cloth 2 using the button fastener 60. The button fastener 60 has an approximately circular, plate-like base 61 and a shaft 62 which extends upward from the base 61. Further, the button fastener 60 is composed of a fastener body 65 forming the shaft 62 and a base core 63 that is an inside reinforcement part of the base 61; and a base cap 64 that covers the base core 63 from a lower side. This base cap 64 is not a cap according to the present invention. When the button 40 is fixed to the cloth 2, the shaft 62 of the button fastener 60 is penetrated upward through the texture 2 and then passed through the cylindrical part 45 from the opening 46 of the button 40. Then, the shaft 62 is brought into contact with the reinforcement plate 44. Thereby, the top 62*a* of the shaft 62 is crushed and slightly expanded radially outward. The deformed top 62*a* of the shaft 62 cannot be passed through the top opening of the cylindrical part 45 and is consequently locked by the locking portion 45*a*. Thereby, the button 40 is fixed to the texture 2 as shown in FIG. 11.

DESCRIPTION OF REFERENCE NUMBERS

1, 2 cloth
10 button fastener
11 base
12 post
13 fastener body
14 base core
20, 50 cap
20A, 50A inner layer
20B, 50B outer layer
21, 51 circumferential side
22 bottom
30 female snap
40 button
41 barrel
42 head
43 button body
60 button fastener

The invention claimed is:

1. A cap of a button or button fastener, comprising a bottom and a circumferential side rising from an edge of the bottom, wherein the cap is composed of an inner layer made of a first material and an outer layer made of a second material which is different from the first material, the inner layer and the outer layer being laminated on each other continuously across the bottom and the circumferential side rising from the bottom, wherein the first material is aluminum or aluminum alloy, and wherein the second material is copper, copper alloy, nickel alloy or zinc alloy.

2. The cap according to the claim 1, wherein a Vickers hardness of the second material is harder than a Vickers hardness of the first material.

3. The cap according to claim 2, wherein the Vickers hardness of the first material is 26 Hv or more and 95 Hv or less, and the Vickers hardness of the second material is 100 Hv or more and 175 Hv or less.

4. The cap according to claim 1, wherein a tensile strength of the first material is less than 260 N/mm2, and a tensile strength of the second material is equal to or higher than 260 N/mm2.

5. The cap according to the claim 4, wherein a tensile strength of the first material is equal to or less than 200 N/mm2.

6. A button group that includes a button group body and a cap which is attached to the button group body by swaging a circumferential side of the cap, wherein the cap comprises a bottom and a circumferential side rising from an edge of the bottom, wherein the cap is composed of an inner layer made of a first material and an outer layer made of a second material which is different from the first material, the inner layer facing the button group body, the outer layer being laminated on one surface of the inner layer which is opposite to the other surface facing the button group body, the inner layer and the outer layer being laminated on each other continuously across the bottom and the circumferential side rising from the bottom, wherein the first material is aluminum or aluminum alloy, and wherein the second material is copper, copper alloy, nickel alloy or zinc alloy.

7. A method for forming a button group that includes a button group body and a cap, comprising:

a step of overlapping a first plate made of a first material and a second plate made of a second material on each other;

a step of punching out the overlapped first and second plates and then molding it into a cup-shaped cap with the first plate placed on an inner side of the cap, the cap comprising a bottom and a circumferential side rising and extending from an edge of the bottom; and a step of swaging the circumferential side of the cap to the button group body to hold the button group body, wherein a Vickers hardness of the second material is harder than a Vickers hardness of the first material.

* * * * *